US005454490A

United States Patent [19]

Johanson

[11] Patent Number: 5,454,490

[45] Date of Patent: Oct. 3, 1995

[54] CONICAL INSETS FOR CHIP BIN

[75] Inventor: Jerry R. Johanson, San Luis Obispo, Calif.

[73] Assignee: Kamyr, Inc., Glens Falls, N.Y.

[21] Appl. No.: 130,525

[22] Filed: Oct. 1, 1993

[51] Int. Cl.[6] ..... B67D 5/62

[52] U.S. Cl. ..... 222/146.4; 222/564

[58] Field of Search ..... 222/146.4, 185, 222/190, 199, 368, 459, 460, 462, 564; 193/32

[56] References Cited

U.S. PATENT DOCUMENTS

| | | | |
|---|---|---|---|
| 733,328 | 7/1903 | Mount | 222/459 |
| 3,543,970 | 12/1970 | Buchner et al. | 222/190 |
| 3,949,888 | 4/1976 | Gessler et al. | 222/564 |
| 4,124,440 | 11/1978 | Sherman | 162/246 |
| 4,721,231 | 1/1988 | Richter | 222/146.4 |

FOREIGN PATENT DOCUMENTS

| | | | |
|---|---|---|---|
| 1146788 | 5/1983 | Canada . | |
| 458386 | 10/1913 | France | 222/564 |
| 707976 | 7/1931 | France . | |
| 1907147 | 9/1970 | Germany . | |
| 2237079 | 2/1974 | Germany . | |
| 1445588 | 12/1988 | U.S.S.R. | 222/185 |
| 2169870 | 7/1986 | United Kingdom | 222/564 |

*Primary Examiner*—Andres Kashnikow
*Assistant Examiner*—Philippe Derakshani
*Attorney, Agent, or Firm*—Nixon & Vanderhye

[57] ABSTRACT

In a chip bin or similar cylindrical upright vessel for storing particulate material the interior generally vertical wall of the vessel has a surface configuration which reduces compression of particulates within the vessel so as to substantially prevent pluggage or particulate bridging. Three or more right circular cone frustrums having a larger diameter at higher portions than at lower portions are provided along the interior generally vertical, either one immediately adjacent the other without significant spacing between them, or in a discontinuous manner being spaced from each other a significant distance. The frustrums insure that the vertical pressure level throughout the vessel is less than about 250 psf (e.g. less than about 200 psf). The vessel may be constructed of concrete using slip forms, with the concrete providing both the exterior and interior of the vessel, or a steel shell may comprise the exterior. The bottom of the vessel includes a hopper, or a vibrating discharge, and if the vessel is a chip bin steam is added at various points within the vessel.

27 Claims, 3 Drawing Sheets

CONICAL INSETS FOR CHIP BIN

BACKGROUND AND SUMMARY OF INVENTION

In large vessels for storing and/or treating particulate material, such as wood chips, coal, metal ore, grain, etc., there is often a tendency for the particulate material to plug or channel, or for bridging of the particular material to occur, due to compression of the particulate material near the bottom of the vessel. Plugging or bridging can shut down entire industrial operations which rely upon the vessel as the source of supply of particulate material, and channeling can lead to improper treatment of the material, and inadequate turnover.

According to the present invention, a vessel for storing particulate material is provided which minimizes or substantially eliminates the pluggage or particulate bridging problems that have occurred in the past, and also minimizes the chances for channeling. This is accomplished according to the present invention by providing a particular surface configuration of the interior vertical wall of the vessel so as to reduce compression of particulates within the vessel. For example, for a chip bin having a height of wood chips within the bin of about 40 feet, and a bottom diameter of about 15 to 20 feet, the vertical solids pressure adjacent the bottom easily exceeds 400 psf. This pressure is so high that with some types of wood (e.g. cedar) it is almost certain to quickly result in pluggage or bridging, and with almost any type of wood chips there is a high probability that plugging or bridging will occur periodically. According to the invention, the vertical solids pressure is reduced so that the maximum within the vessel is about 250 psf, and preferably the vertical solids pressure is maintained at about 200 psf or less. This approximately one-half (or more) reduction in the vertical solids pressure substantially prevents pluggage or particulate bridging.

The surface configuration of the interior generally vertical wall of the upright cylindrical vessel according to the invention is preferably provided by means defining a surface configuration which comprises a plurality of right circular cone frustrums having a larger diameter at higher portions thereof than at lower portions thereof. Each of the cone frustrums may make an angle with respect to the vertical of about 10°–30°, and the cone frustrums can be discontinuous along the interior vertical wall, being spaced from each other a significant distance, or they may be provided in sequence, one immediately adjacent the other, without significant spacing between them. Where the vessel has a diameter of about 15–20 feet (adjacent the bottom thereof adjacent a particulate material discharge is located), the frustrums are positioned so that the bottom terminations thereof are vertically spaced from each other a distance S, in feet, determined according to the formula $S=6.83-0.26\ (D-15)$, where D is the bottom diameter of the vessel in feet. Also, under such circumstances the uppermost of the cone frustrums is not more than about 1.5 S from the top level of particulates in the vessel.

Where the vessel is a chip bin, a vibrating discharge is provided at the bottom, and there are also provided means for adding steam to the vessel. Steam may be added to the vessel at the vibratory discharge, as is conventional, and also may be added at one or more of the cone frustrum bottom terminations.

The cone frustrums may be solid concrete and define both the exterior and interior of the vessel, or they may be concrete disposed within a steel shell which surrounds them and provides the exterior of the vessel. Alternatively, the vessel may be a steel cylinder, and the cone frustrums may be metal plate connected to the interior generally vertical wall with portions thereof spaced from the wall (with steam addition at those portions of desired).

According to another aspect of the present invention, a method of constructing a generally upright vessel using a slip form which forms a right circular cone frustrum interior surface, is provided. The method comprises the steps of substantially sequentially: (a) Mounting a hopper at substantially the lowermost portion of the vessel. (b) Placing the slip form above the hopper. (c) Pouring concrete utilizing the slip form to form a first generally cylindrical wall segment above the hopper, and defining a right circular cone frustrum interior surface. (d) After the concrete poured in step (c) has hardened, moving the slip form above the formed concrete generally cylindrical wall segment. (e) Repeating steps (c) and (d) until a vessel of the desired height has been constructed of generally cylindrical concrete wall segments. And (f) providing a top structure on the topmost generally cylindrical wall segment. There is also preferably the further step of providing a metal support ring beneath the slip form before pouring each of the right circular cone frustrums.

According to yet another aspect of the present invention, another method of constructing a generally upright vessel using at least one slip form is provided. This method comprises the following steps: (a) Providing a cylindrical steel shell with steel shelves. (b) Mounting a hopper interior of the steel shell at substantially the lowermost portion of the vessel. (c) Placing one or more slip forms above the steel shelves. (d) Pouring concrete utilizing the slip forms to form right circular cone frustrum interior surfaces within the steel shell at the steel shelves. And (e) providing a top structure on the topmost portion of the steel shell.

It is the primary object of the present invention to provide an upright generally cylindrical vessel for storing particulate material where there is a minimum chance of the particulates plugging or bridging due to compression, and to a method of constructing such a vessel. This and other objects of the invention will become clear from an inspection of the detailed description of the invention and from the appended claims.

DETAILED DESCRIPTION OF DRAWINGS

Figure 1:
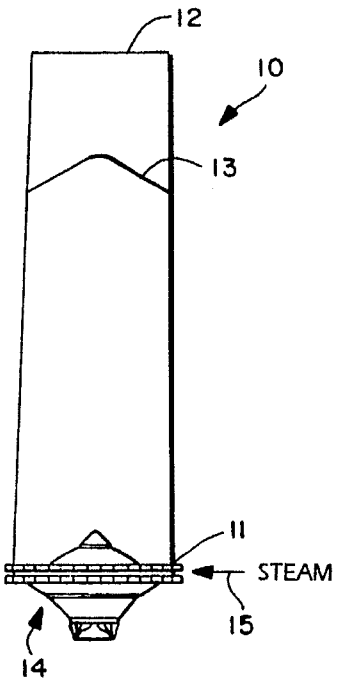
FIG. 1 (Prior Art)
FIG. 1 is a schematic side view, with the side of the vessel cut away for clarity of illustration, of an exemplary prior art chip bin.

FIG. 1 illustrates a conventional, prior art chip bin generally by reference numeral 10. The chip bin 10 is generally cylindrical, having a slightly greater diameter at the bottom 11 than at the top 12 (e.g. a diameter of 16 feet 2 inches at the bottom 11 and 15 feet 0 inches at the top 12). A level of chips 13 is established within the vessel 10. Although not shown in FIG. 1, the chip bin 10 typically has an air lock feeder mounted at an inlet thereto at the top 12, and the flow of chips into the bin 10 is regulated by a set of counter-weighted chip gates also located at the top of the bin. The level of chips within the bin 10 is monitored by means of a gamma radiation source and a gamma radiation detector, and at the bottom 11 is a discharge structure 14. The discharge 14 typically comprises a vibrating inverted cone baffle assembly, known by the trademark "Vibra-Bin". Typically, steaming takes place in the vessel 10, steam being added to the base of the bin by steam headers which distribute steam beneath a conical baffle, the steam introduction being shown generally by line 15 in FIG. 1, and being described in U.S. Pat. Nos. 4,124,440 and 4,721,231 and Canadian Patent 1,146,788.

Figure 2:
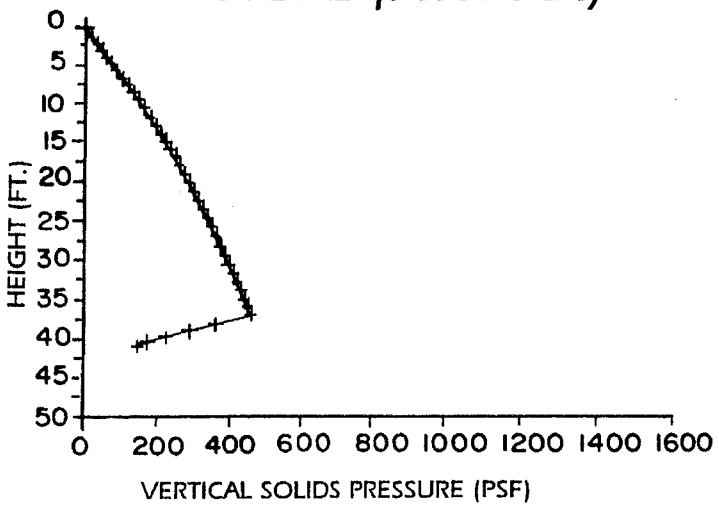
FIG. 2 (Prior Art)
FIG. 2 is a graphical representation of the vertical solids pressure in the chip bin of FIG. 1, plotted against the height of chips in the chip bin.

In the prior art bin 10, as illustrated in FIG. 1, the vertical solids pressure adjacent the bottom 11 is high, for example, if the chip column 13 within the bin is about 40 feet tall, the vertical solids pressure adjacent the bottom 11 is over 400 psf. FIG. 2 is a graphical representation illustrating the vertical solids pressure in the bin 10 as a function of chips height. When the vertical solids pressure is greater than about 250 psf for many types of wood chips, plugging of the bin 10, or particle bridging, is likely to occur. Also, non-uniform treatment of the chips by the steam added at 15 often results since the steam and chips have a tendency to channel through the bin 10. Of course, pluggage or particle bridging can shut down the whole pulp mill associated with the bin 10, while non-uniform steaming of the chips results in lower quality pulp than is desired.

According to the present invention, a generally cylindrical upright vessel 17 is provided (see FIG. 3) which overcomes the particle bridging and pluggage problems associated with the bin 10 as described above. The bin 17 according to the invention includes a top 18, a bottom 19, and a generally vertical interior wall 20, with a level 21 of wood chips therein, and a vibratory conical discharge structure 22, all essentially comparable to structures in the conventional chip bin 10. What is different according to the invention, however, is that spaced along the interior wall 20 at at least two different points are right circular cone frustrums, shown generally by reference numerals 24 in FIG. 3. These frustrums 24 comprise means defining a surface configuration of the interior vertical wall 20 to reduce the compression of particulates within the vessel 17 so as to substantially prevent pluggage or particulate bridging. For the particular embodiment of a chip bin 17 as the upright generally cylindrical vessel, the frustrums 24 preferably comprise means for insuring that the vertical pressure level throughout the vessel 17 is less than about 250 psf, preferably less than about 200 psf. FIG. 4 is a graphical representation of the vertical solids pressure plotted against height of the chips column (21) of the vessel 17 according to the invention. As can be seen in FIG. 4, the vertical solids pressure is approximately at a maximum of about 200 psf within the vessel 17, and under such circumstances particulate bridging and pluggage do not occur, even with difficult to handle wood species such as cedar.

Figure 3:
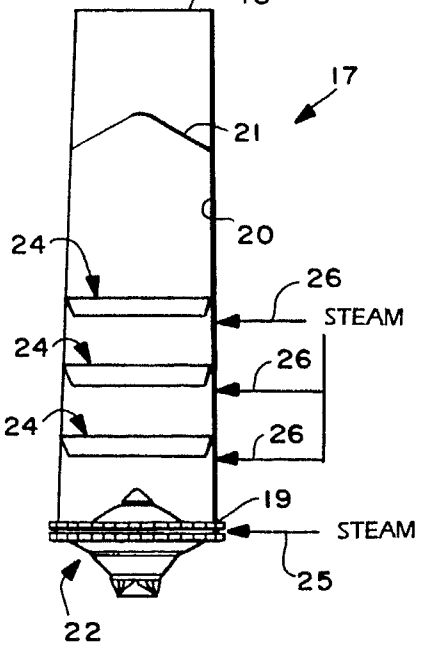
FIG. 3 is a view like that of FIG. 1 only for an exemplary chip bin according to the present invention.
Figure 4:
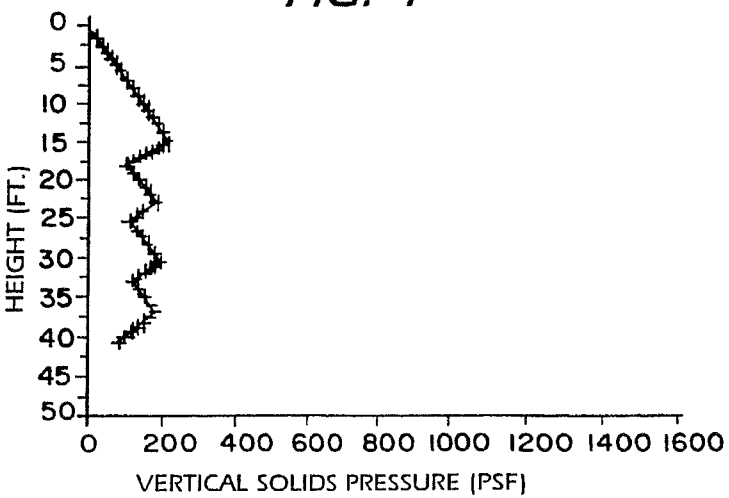
FIG. 4 is a graphical representation like that of FIG. 2 only for the chip bin of FIG. 3.

Also, utilizing the structure 17 of FIG. 3, steaming of the chips is more uniform. Even if steam is added just at 25, like for the conventional chips bin 10 with steam addition 15 (FIG. 1), the steaming is more uniform. However, the structure of FIG. 3 also lends itself to other steam introduction ports which can make the steaming even more uniform. For example, as schematically illustrated in FIG. 3, one or more steam addition lines 26 can be provided associated with the bottoms of each of the conical frustrums 24.

Figure 5:
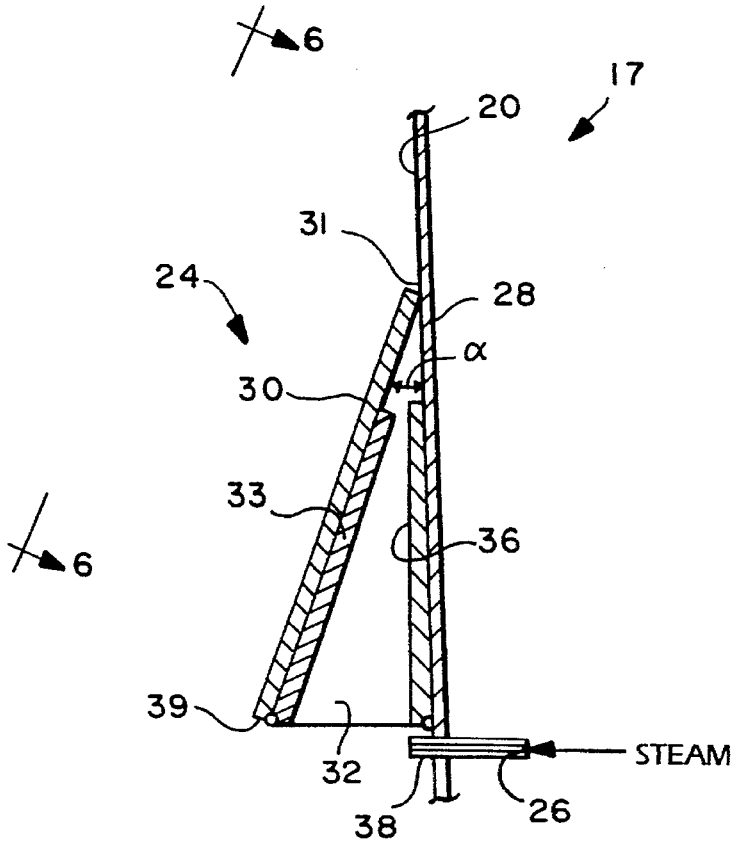
FIG. 5 is a detail side cross-sectional view showing the connection of one of the conical inserts of the chip bin of FIG. 3 to the cylindrical interior wall of the vessel.
Figure 6:
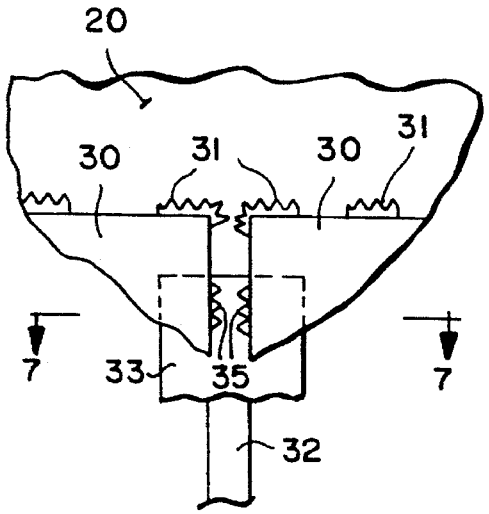
FIG. 6 is a detail interior view of the insert of FIG. 5 looking in along line 6—6 thereof.
Figure 7:
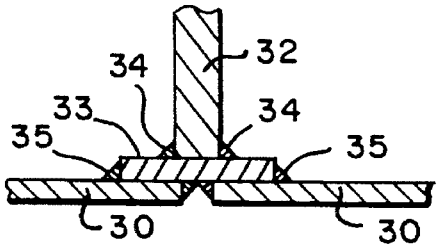
FIG. 7 is a cross-sectional view of the insert of FIGS. 5 and 6 taken alone line 7—7 of FIG. 6.

The frustrums 24 may be retrofit to a conventional chip bin 10 so as to produce the chip bin 17 of FIG. 3. FIGS. 5 through 7 illustrate one particular detailed way that this can be constructed.

As seen in FIG. 5, the interior generally vertical interior wall 20 is part of an outer steel shell 28 of the vessel 17. Each right circular cone frustum 24 is provided by steel plates 30. A continuous steel plate curved and formed in a configuration closely approximating a right circular cone frustrum can be provided, or a number of different plates can be provided, as illustrated in FIG. 6, the plates 30 being slightly spaced from each other where they are adjacent each other, and welded—as indicated by welds 31—to the side wall 20. Supporting the frustum-defining plates 30 there also is preferably a gusset 32 (shown in all of FIGS. 5 through 7) which has a support plate 33 on a portion thereof engaging the frustrum-defining plates 30. The gusset 32 is welded to the plate 33 as indicated by welds 34 in FIG. 7, and the plate 34 is in turn welded to the plates 30 as indicated by welds 35 in FIGS. 6 and 7. At the opposite end of the gusset 32 from the plate 33 there is also a supporting plate 36 (see FIG. 5) which is welded to the interior of the shell 28 (i.e. to surface 20). In order to provide proper support for the plates 30 around the entire internal circumference of the vessel 17, a plurality of such gussets and associated plates 33, 36 are provided; typically twelve gussets 32 are provided around the internal circumference of the vessel 17 if it has a diameter at bottom 19 of about 15–20 feet.

While the plates 30, 33, 36 and gusset 32 may be made of a wide variety of materials, preferably they are made of steel. For example, the plates 30 and 33 may be ½ inch thick plates, the plates 30 having a length (the dimensions extending generally in the vertical direction) of about 24 inches, while the gusset 32 is about ¾ inch thick steel, having a triangular shape with the width of the base of approximately 8 inches, tapering to a point adjacent the top. The plate 36 may have a thickness of about ⅝ inches, and may be 12 inches wide, while the plates 33 are about 4 inches wide. One particular steel of which the plates 30, 33, 36 and the gusset 32 may be constructed is 304L stainless steel.

FIG. 5 schematically illustrates a steam introduction port 38, penetrating the wall 28, and connected up to steam branch 26, that may be provided for introducing steam below the bottom of the insert 24. At that point, the bottom termination 39 of the insert 24 is spaced approximately 8 inches from the vessel wall 28 so that there is a generally open volume so that the steam can flow freely into the vessel 17.

Note that the frustrum-defining plates 30 preferably form an angle alpha with respect to the wall 28 (which is generally vertical) that is about 20° (as illustrated in FIG. 5), and typically is about 10°–30° . The exact angle alpha will be dependent in part upon the particulate material being contained by the vessel 17 (e.g. wood chips, coal, ore, grain, etc.) and perhaps the height and the diameter of the vessel 17.

Where the vessel 17 has a diameter of about 15–20 feet, the cone frustrums 24 may be spaced according to a particular formula, for optimum functionality. That is, the frustrums 24 are positioned so that the bottom terminations 39 are vertically spaced from each other a distance S, in feet, determined according to the formula S=6.83–0.26 (D–15), where D is the bottom diameter of the vessel in feet. Under such circumstances it is also preferred that the uppermost of the cone frustrums 24 is not more than about 1.5 S from the top level of particulates (e.g. the chip level 21) in the vessel 17. For example, for a chip bin 17 having a bottom diameter (adjacent 19) of 16 feet 2 inches, and a top diameter (at the level of the chips 21) of about 15 feet, each of the frustrums 24 will be spaced from each other about 6 feet 6 inches (that is the bottom terminations 39 of each are about 6 feet 6 inches from the next termination), and the top frustrum 24 is spaced roughly 9 to 12 feet from the expected level 21 of particulates therein (which may be controlled by a conventional gamma radiation source and gamma radiation detector, as described above with respect to the conventional chip bin 10).

Indicative of the dramatic results that can be achieved according to the invention, a conventional prior art chip bin having a bottom diameter of about 16 feet was functioning so poorly that mill personnel controlled the chip bin level so that it was at 25% of the total bin height. There were frequent chip buildups in the chip quadrants, and over time the quadrant buildups resulted in an erratic flow of chips to the chip meter. The bin "hung up" twelve times in ten months, eleven times while running cedar and once while running hemlock. Chip bin quadrant pluggage resulted in a live bottom portion of the bin shifting to one side, which occurred prior to "hang up" Because of the hang up problems, cedar runs were limited to four days.

A chip bin was retrofit with conical inserts 24 according to the present invention, spaced from each other along the interior wall 20 as schematically illustrated in FIG. 3. Three such inserts were provided, the bottom termination 39 of the bottommost one spaced about 8 feet from the bottom 19, with the bottom terminations 39 of the lowermost insert and the next insert spaced from each other 6 feet 6 inches, and the intermediate insert bottom termination 39 spaced from the top insert 24 bottom termination 39 6 feet 6 inches. After these modifications, the chip bin level set point was increased from 25% to 50% of the total bin height, and the bin was run without hang ups, even though there were cedar runs of eight days duration. Steam consumption within the bin increased compared to the same production rate prior to modification, indicating more uniform and better steaming of the chips. Also, the mill operators felt that the impregnation vessel and digester level control loops of the pulp mill were much more easily controlled due to more thoroughly uniform steaming of the chips resulting in a steadier column movement within the digester, and a more constant fill factor in the chip meter of the chip bin, resulting in an uninterrupted chip flow to the digester. Also, prior to utilization of the conical inserts 24 according to the present invention, it was necessary to limit the high pressure feeder speed in order to keep down vibrations in the top circulating line when cedar was being run. Utilizing the invention the high pressure feeder speed was increased by 1 rpm (about 8%), with no T.C. line vibration problems.

While the structure 17 described above with respect to FIGS. 3 and 5 through 7 is particularly suitable for use as a chip bin, the invention is applicable to other generally cylindrical vessels for storing other types of particulate material, such as coal, ores, and grains. In such vessels, typically referred to as silos, hoppers are provided at the bottom, the hoppers having a steep enough discharge to cause flow along the walls of the silos, typically known as "mass flow". During mass flow, with some relatively incompressible bulk solids, the excessive vertical loads can cause pulsations of the entire solids column above the hopper. These pulsations can cause structural failure, and are of particular concern in larger silos. The use of the conical inserts 24 according to the present invention minimizes the vertical loads, thereby eliminating the pulsations.

Figure 9:
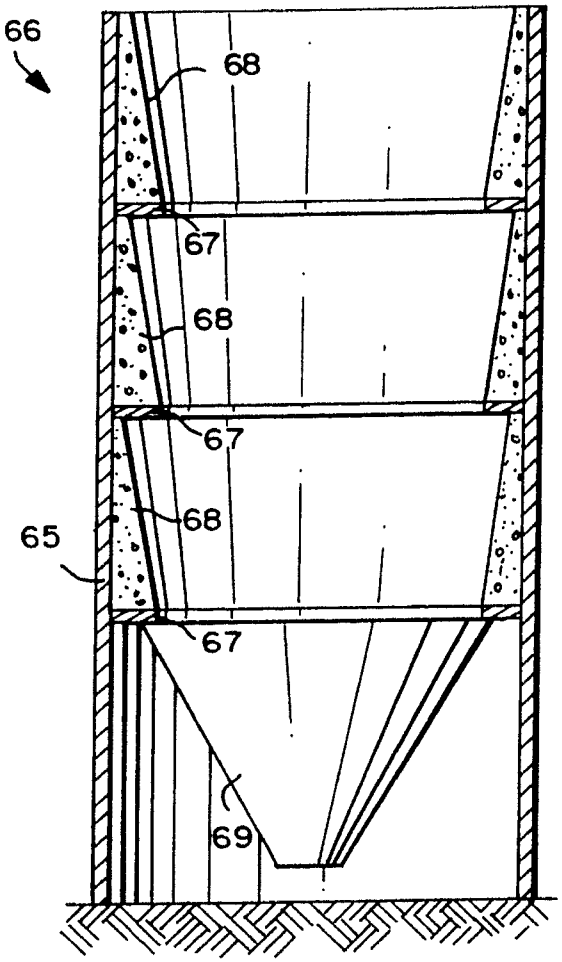
FIG.9 is a view like that of FIG. 8 only for yet another exemplary embodiment of a particulate material storage vessel according to the present invention.
Figure 8:
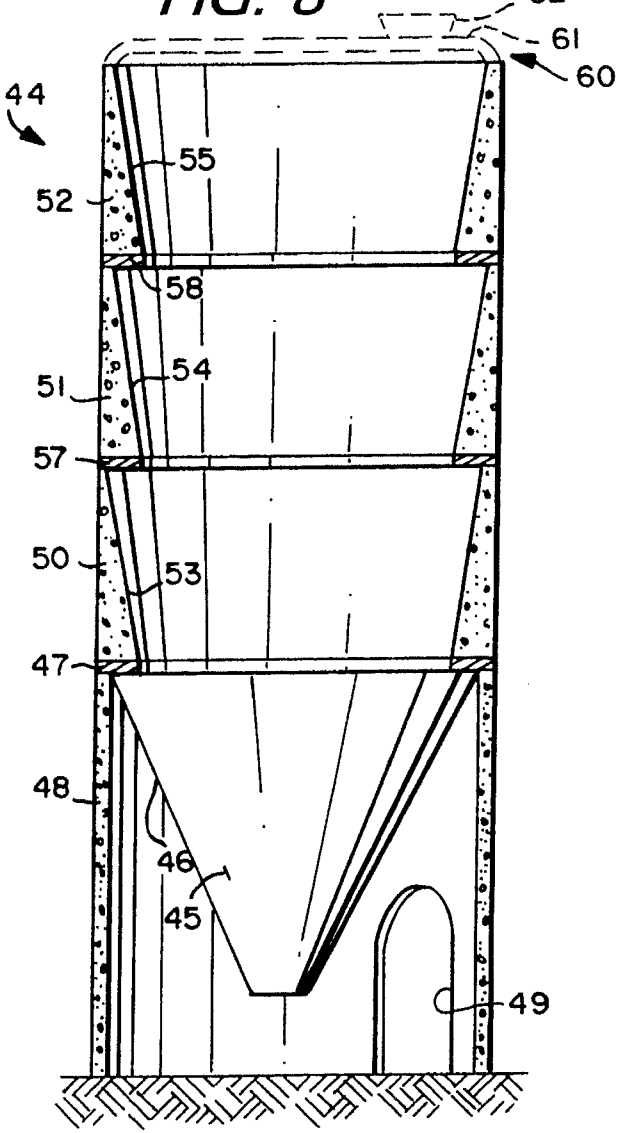
FIG. 8 is a side view, partly in cross section and partly in elevation, of another embodiment of a particulate material storage vessel according to the present invention.

While in the FIGS. 3 and 5 through 7 embodiment the conical inserts 24 are shown spaced from each other along the length of the vertical wall 20, the cone frustrums may be provided in sequence, one immediately adjacent the other, without significant spacing therebetween, as seen in the two exemplary embodiments illustrated in FIGS. 8 and 9.

For the embodiment illustrated in FIG. 8, the upright generally cylindrical vessel 44 can typically be used as a silo, for example for storing coal, ore, or grain. The silo 44 includes a hopper 45 at the bottom thereof, the hopper having steep walls 46 so as to provide mass flow within the silo 44. The hopper 45 may be connected to a metal support ring 47. The support ring 47 is supported by a cylindrical base or a plurality of legs 48. In FIG. 8 the element 48 is illustrated as a concrete hollow cylindrical base, which may have one or more openings 49 therein to access the interior to allow workers to work on the hopper 45 if necessary.

In the embodiment of FIG. 8, the portions of the silo 44 above the hopper 45 are formed by concrete generally cylindrical wall segments, in this case three segments 50, 51, 52, being shown. Each segment 50–52 has an interior surface configuration 53–55, respectively, in the form of a right circular cone frustrum, making an angle with respect to the vertical of roughly about 10°, the cone frustrums 53–55 relieving the vertical pressure, just like for the embodiment according to the invention illustrated in FIG. 3.

The silo 44 may be constructed utilizing a single slip form. For example, first the slip form is placed on the steel ring 47, and the concrete for the first wall segment 50 is poured. After the concrete for the segment 50 hardens, the steel plate 57 is placed on top of the segment 50, the slip form is placed on top of the plate 7, and the concrete forming the segment 51 is poured. This same sequence of steps is then repeated for the metal support ring 58 and segment 52.

After the top segment 52 is constructed, and the slip form removed, a top structure—shown generally by reference numeral 60, and in dotted line in FIG. 8—is provided. The top structure 60 may comprise any conventional top structure for a silo 44, typically being some sort of protective covering (roof) 61 having an inlet 62 therein for the introduction of particulate material to be stored.

The structure illustrated in FIG. 9 is similar to that illustrated in FIG. 8 except that instead of the silo 44 having a concrete interior and exterior, a steel tubular upright shell 65 forms the exterior of the silo 66. The steel shell 65 has a plurality of steel shelves 67, each supporting a concrete segment having a right circular cone frustrum 68, and the lowermost shelf 67 supporting a hopper 69. The structure in FIG. 9 is formed by putting slip forms in association with each of the shelves 67 and then pouring concrete for a particular segment 68. Only one slip form need be utilized, or a slip form can be associated with each of the shelves 67 and the concrete segments 68 all poured at about the same time. A top structure of conventional construction also is typically associated with the silo 66, but is not shown in FIG. 9.

It will thus be seen that according to the present invention an upright generally cylindrical vessel for storing particulate material has been provided which substantially prevents the pluggage or particulate bridging problems that are common in the prior art. The invention also comprises a method of constructing such a vessel. While the invention has been herein shown in what is presently conceived the most practical and preferred embodiment thereof, it will be apparent to those of ordinary skill in the art that many modifications may be made thereof within the scope of the invention, which scope is to be accorded the broadest interpretation of the appended claim so as to encompass all equivalent structures and methods.

What is claimed is:

1. A chip bin comprising:

an upright generally cylindrical vessel having a top and a bottom, for storing wood chips, and a large enough diameter and height so that the chips have a tendency to plug or channel or for bridging to occur, due to compression of wood chips near the bottom of the vessel, said vessel comprising: a vibratory discharge at said bottom of said vessel comprising: a vibratory discharge at said bottom of said vessel; an interior generally vertical wall; and means for defining a surface configuration of said interior generally vertical wall to reduce compression of chips within said vessel so as to substantially prevent pluggage or bridging; said means for defining a surface configuration comprises a plurality of right circular cone frustums having a larger diameter at higher portions thereof than at lower portions thereof and means for adding steam to said vessel.

2. A chip bin as recited in claim 1 wherein said means for defining a surface configuration comprises means for ensuring that the vertical solids pressure level throughout said vessel is less than about 250 psf.

3. A chip bin as recited in claim 1 wherein said vessel has a diameter of about 15–20 feet, and wherein each of said frustum has a bottom termination, and wherein said frustum are positioned so that said bottom terminations thereof are vertically spaced from each other a distance S, in feet, determined according to the formula S=6.83–0.26 (D-15), where D is the bottom diameter of said vessel in feet.

4. A chip bin as recited in claim 3 wherein the uppermost of said cone frustums is not more than about 1.5 S from the top level of particulates in said vessel.

5. A chip bin as recited in claim 1 wherein said cone fustrums each make an angle with respect to the vertical of about 10–30 degrees.

6. A chip bin as recited in claim 1 wherein said cone frustums are discontinuous along said interior generally vertical wall, being spaced from each other a significant distance.

7. A chip bin as recited in claim 1 wherein said cone frustums are provided in sequence, one immediately adjacent the other, without significant spacing therebetween.

8. A chip bin as recited in claim 7 wherein said cone frustums are solid concrete, and define the exterior and interior of said vessel.

9. A chip bin as recited in claim 7 wherein said cone frustums are solid concrete, and wherein a steel shell surrounds said cone fustrums and provides the exterior of said vessel.

10. A chip bin as recited in claim 6 wherein said cone frustums are metal plate connected to said interior generally vertical wall, portions thereof spaced from said wall.

11. A chip bin as recited in claim 1 wherein said means for defining a surface configuration comprises means for insuring that the vertical solids pressure level throughout said vessel is less than about 200 psf.

12. A chip bin as recited in claim 1 wherein at least three of said cone frustums are provided along said interior generally vertical wall.

13. A chip bin as recited in claim 1 wherein said means for introducing steam into said vessel includes means adjacent the bottom of at least one of said cone frustums for introducing steam into the vessel.

14. A chip bin as recited in claim 1 wherein all of said frustums are vertically aligned and concentric with each other.

15. A generally cylindrical chip bin for storing wood chips, comprising:

an upright generally cylindrical vessel having a top and bottom, and an interior vertical wall for storing wood chips, and a large enough diameter and height so that the chips have a tendency to plug or channel for bridging to occur, due to compression of wood chips near the bottom of the vessel;

a vibratory discharge at said bottom;

said interior wall comprising a plurality of right circular cone frustums each having a largest diameter portion adjacent the highest portion thereof, and a smallest diameter portion adjacent the lowest portion thereof; and means for introducing steam into said chip bin.

16. A chip bin as recited in claim 15 wherein said cone frustums are discontinuous along said interior generally vertical wall, being spaced from each other a significant distance.

17. A chip bin as recited in claim 16 wherein said cone frustums are metal plate connected to said interior generally vertical wall, portions thereof spaced from said wall.

18. A chip bin as recited in claim 15 wherein said cone frustums are provided in sequence, one immediately adjacent the other, without significant spacing therebetween.

19. A chip bin as recited in claim 18 wherein said cone frustums are solid concrete, and wherein a steel shell surrounds said cone frustums and provides the exterior of said vessel.

20. A chip bin as recited in claim 18 wherein said cone frustums are solid concrete, and define the exterior and interior of said vessel.

21. A chip bin as recited in claim 15 having a diameter of about 15–20 feet, and wherein each of said frustums has a bottom termination, and wherein said frustums are positioned so that said bottom terminations thereof are vertically spaced from each other a distance S, in feet, determined according to the formula S=6.83–0.26 (D-15), where D is the bottom diameter of said vessel in feet.

22. A chip bin as recited in claim 21 wherein the uppermost of said cone frustums is not more than about 1.5 S from the top level of particulates in said vessel.

23. A chip bin as recited in claim 15 wherein said cone frustums each make an angle with respect to the vertical of about 10°–30° .

24. A chip bin as recited in claim 15 wherein said means for introducing steam into said vessel includes means adjacent the bottom of at least one of said cone frustums for introducing steam into the vessel.

25. A chip bin as recited in claim 15 wherein all of said frustums are vertically aligned and concentric with each other.

26. A chip bin for particulate material, comprising:

and upright generally cylindrical vessel having a top and bottom, and an interior vertical wall for storing wood chips, and a large enough diameter and height so that the chips have a tendency to plug or channel for bridging to occur, due to compression of wood chips near the bottom of the vessel;

a discharge at said bottom; and said interior wall comprising a plurality of right circular cone frustums each having a largest diameter portion adjacent the highest portion thereof, and a smallest diameter portion adjacent the lowest portion thereof, all of said frustums vertically aligned and concentric with each other.

27. An upright generally cylindrical vessel having a top and a bottom, for storing wood chips, and a diameter of about 15–20 feet, and a height large enough so that the wood chips have a tendency to plug or channel or for particulate bridging to occur, due to compression of said wood chips near the bottom of the vessel, said vessel comprising:

a discharge at said bottom of said vessel;

an interior generally vertical wall; and means for defining a surface configuration of said interior generally vertical wall to reduce compression of said wood chips within said vessel so as to substantially prevent pluggage or particulate bridging, comprising a plurality of right circular cone frustums having a larger diameter at higher portions thereof than at lower portions thereof; and wherein each of said frustums has a bottom termination, and wherein said frustums are positioned so that said bottom terminations thereof are vertically spaced from each other a distance S, in feet, determined according to the formula $S=6.83-0.26\ (D-15)$, where D is the bottom diameter of said vessel in feet.

* * * * *